US006112913A

United States Patent [19]

Rindoks et al.

[11] Patent Number: 6,112,913

[45] Date of Patent: Sep. 5, 2000

[54] SUPPORT ARRANGEMENT FOR FURNITURE SYSTEM

[75] Inventors: Kurt P. Rindoks; Alan W. Stephenson; Don F. Olson, all of Statesville, N.C.

[73] Assignee: Kewaunee Scientific Corporation, Statesville, N.C.

[21] Appl. No.: 08/922,514

[22] Filed: Sep. 3, 1997

[51] Int. Cl.[7] ..... A47F 5/08

[52] U.S. Cl. ..... 211/90.02; 211/90.04; 211/187; 108/108; 312/247

[58] Field of Search ..... 211/90.04, 90.01, 211/90.02, 187, 190, 191; 108/106, 107, 108, 147.11, 147.12; 312/247

[56] References Cited

U.S. PATENT DOCUMENTS

| | | | |
|---|---|---|---|
| 3,234,897 | 2/1966 | Berk | 108/147.11 X |
| 3,631,821 | 1/1972 | Zachariou | 211/187 X |
| 3,993,002 | 11/1976 | Stroh | 108/108 |
| 5,004,201 | 4/1991 | Bessinger . | |
| 5,069,408 | 12/1991 | Bessinger . | |
| 5,072,839 | 12/1991 | Arnone | 108/147.11 X |
| 5,348,385 | 9/1994 | Berg . | |
| 5,799,588 | 9/1998 | Engel | 108/108 |

*Primary Examiner*—Blair M. Johnson
*Attorney, Agent, or Firm*—Kennedy Covington Lobdell & Hickman

[57] ABSTRACT

A support assembly for a furniture system including a pair of standards which extend vertically in spaced relation, each standard having two rows of openings formed therein to extend vertically in spaced relation to one another, with the outermost rows on the pairs of standards having a first spacing therebetween and the innermost rows having a second spacing therebetween less than the first spacing. A first support member is mounted on the standards by a first arrangement for detachably mounting disposed in the outermost rows of openings, and the first support member has a first support surface which extends outwardly from the standards and braces which extend vertically along the standards. A second support member is mounted on the standards and between the braces by a second arrangement for detachably mounting disposed in the innermost rows of openings, and the second support member has a second support surface which extends outwardly from the standards intermediate the braces of the first support member, whereby the first and second support surfaces can be detachably positioned relative to each other in a useful and convenient manner.

19 Claims, 5 Drawing Sheets

SUPPORT ARRANGEMENT FOR FURNITURE SYSTEM

BACKGROUND OF THE INVENTION

The present invention relates generally to a support arrangement for a system of furniture components and, more particularly, to a support assembly including two support members which each have support surfaces thereon, one of the support members being detachably mounted in a pair of standards and having braces which extend vertically along the pair of standards, and the other support member being detachably mounted between the braces in the standards.

It has long been widely known to selectively position work surfaces or shelves on support members, such as brackets, with the brackets detachably mounted by hooks or other connectors in rows of vertically extending openings, whereby the work surfaces or shelves can be located at any one of a number of vertical portions. A wide variety of shelving, brackets, and standards of this general type are available in hardware stores, home centers, and many other outlets. Such brackets typically include a vertical edge portion from which the hooks or connectors project outwardly, with such vertical edge surfaces positioned adjacent the standard or stanchion when installed.

Brackets which are capable of carrying any significant load in such an arrangement ordinarily include a vertically extending support brace with the hooks or connectors projecting therefrom. When installed in a row of openings on a standard or stanchion, such a brace typically occupies a sizable portion of the standard or stanchion's vertical extent, thereby covering and blocking access to a significant number of the openings on such standard or stanchion.

It is frequently convenient and useful to position a pair of support surfaces one above the other in close relation—such as, for example, a shelf below a work surface for supporting books, equipment, or other items while leaving the work surface relatively clear. However, the braces typically required to support a work surface mounted in such rows of openings will extend to cover such an extent of the openings that brackets for the second support surface or shelf cannot be mounted in the rows of openings at a convenient position close to the work surface in the area into which the braces extend. Thus, such braces effectively reduce the usefulness and adaptability of such furniture systems by preventing convenient mounting of support surfaces in this manner.

Furniture systems which incorporate two vertical rows of openings on each standard are also known in the art, but such standards have previously been used for clearly defined purposes and functions. The standards disclosed in Berg U.S. Pat. No. 5,348,385, for example, are used to allow shelves, tables, and other elements to be mounted in side-by-side fashion on a series of cooperating vertical standards. Thus, in the two rows of slots on any given standard as shown in Berg, a bracket will be mounted in one row for supporting a shelf extending off to one side of the standard, while a second bracket will be mounted in the other row of slots to support another shelf extending laterally in the opposite direction.

Standards having two rows of slots formed therein are also found in the E3200 and 85/185 systems sold by the Knape & Vogt Manufacturing Company of Grand Rapids, Mich. These double-slotted standards, however, are designed to be used with brackets which themselves each have a double row of hooks projecting therefrom and configured to engage the double row of slots. Thus, each individual bracket engages both rows of slots in each standard for the purpose of providing a high strength mounting for the bracket to support large shelves or other surfaces carrying heavy loads.

Neither the Knape & Vogt designs nor the standards disclosed in the Berg patent provide any solution to the above-described problem of positioning a support surface such as a shelf in a location close to and vertically aligned with another support surface having braces extending toward such location.

Accordingly, a need exists for a support assembly furniture system in which a support member including a support surface such as a shelf can be positioned intermediate braces of another support member also having a support surface, such as a work surface, with both support members being detachably mounted on standards or stanchions.

SUMMARY OF THE INVENTION

In accordance with the present invention, a support assembly for a furniture system is provided to allow convenient and useful positioning of two support surfaces located in a predetermined relationship with respect to each other. Briefly summarized, the present invention provides a support assembly which includes a pair of standards which extend vertically in spaced relation, each of the standards having two rows of openings formed therein to extend vertically in spaced relation to one another so that the outermost rows in the pair of standards have a first spacing therebetween and the innermost rows on the pair of standards have a second spacing therebetween which is less than the first spacing.

A first support member is detachably mounted on the standards by a first detachable mounting arrangement which is disposed in the outermost rows of openings, and the first support member has a first support surface which extends outwardly from the standards and braces mounted in the standards.

A second support member is detachably mounted on the standards between the braces by a second mounting arrangement which is disposed in the innermost rows of openings. The second support member has a second support surface which extends outwardly from the standards intermediate the braces of the first support member. The first support surface may be a work surface, and the second support surface may be a shelf, but other combinations may also be used.

The openings on each standard may be formed as slots, and the braces may each have a first vertical edge portion positioned adjacent the standards. The first detachable mounting arrangement may include one or more hooks projecting outwardly and downwardly from each of the first vertical edge portions for detachable mounting engagement in one of the slots in the outermost rows. The second support member may have a pair of second vertical edge portions, each of which are adjacent one of the standards, and the second detachable mounting arrangement may include one or more hooks projecting outwardly and downwardly from each of the second vertical edge portions for detachable mounting engagement in one of the slots in the innermost rows.

The standards of the present invention may also include web portions intermediate the slots in each of the rows, and each of the first vertical edge portions may include an upper portion and a lower portion, with each of the hooks of the first arrangement for detachably mounting being positioned adjacent the upper portion of its respective vertical edge portion. The present invention may further include an abutment projecting outwardly from the lower portion of each of the first vertical edge portions for contacting one of the web portions of the standard so as to space the lower portion from the standard.

In accordance with another aspect of the present invention, the support assembly may include a pair of stanchions extending vertically in spaced relation and an arrangement for defining two rows of openings formed to extend vertically in spaced relation on each of the stanchions so that the outermost rows of openings on the pair of stanchions have a first spacing therebetween, and the innermost rows of openings in the pair of stanchions have a second spacing therebetween less than the first spacing. Each of the first vertical edge portions of the first support member may be adjacent one of the stanchions, and the first arrangement for detachably mounting may include a connector member projecting outwardly from each of the first vertical edge portions for detachable mounting engagement in one of the openings in the outermost rows. Each of the second vertical edge portions of the second support members may be adjacent one of the stanchions, and the second arrangement for detachably mounting may include a connector member projecting outwardly from each of the second vertical edge portions for detachable mounting engagement in one of the openings in the innermost rows.

Accordingly, the present invention provides a support assembly for a furniture system in which two support members each having support surfaces can be positioned in a convenient and highly useful manner. One support member has braces which extend vertically along a pair of standards and is detachably mounted in a pair of outermost rows of openings in the standards, while the second support member is detachably mounted between the braces in a pair of innermost rows of openings on the standards. The invention thus provides for beneficial positioning of the two support members relative to each other in detachable fashion.

DESCRIPTION OF THE PREFERRED EMBODIMENT

Figure 1:
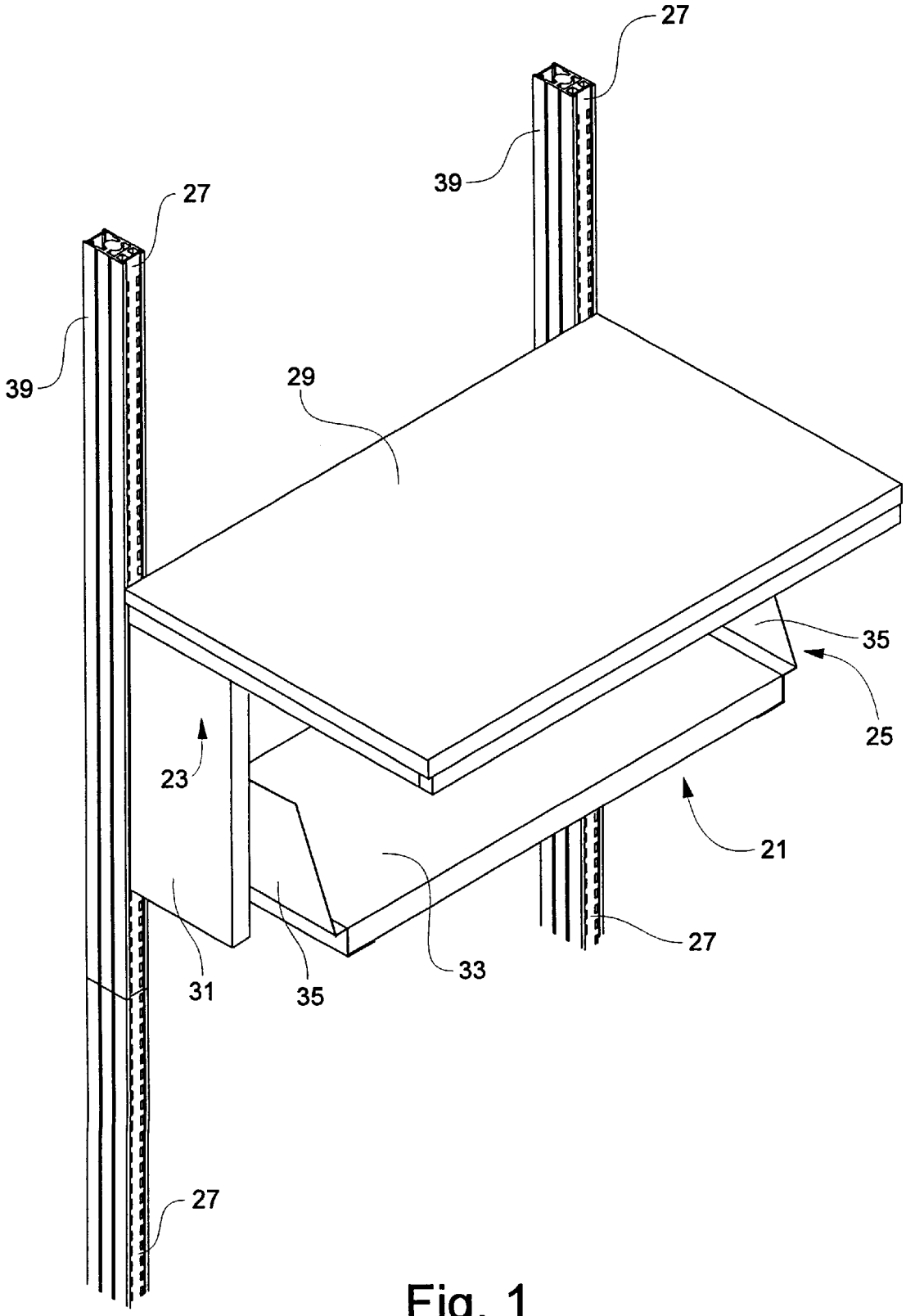
FIG. 1 is a perspective view illustrating the support assembly of the present invention with two support members detachably mounted on a pair of standards.

Looking now in greater detail at the accompanying drawings, FIG. 1 illustrates in perspective view the support assembly 21 of the present invention with a first support member 23 and second support member 25 mounted on vertically extending standards 27. The first support member 23 includes a desk or work surface 29 and a pair of braces 31, while the second support member includes a shelf 33 and a pair of braces 35.

The standards 27, each include slot-shaped openings 37 (see FIG. 2), and are each mounted in a stanchion 39 or similar post, which can be free-standing, part of a larger furniture unit which incorporates a number of such stanchions or posts, or mounted to a wall through conventional means, all of which are well-known in the art and conventional.

Figure 2:
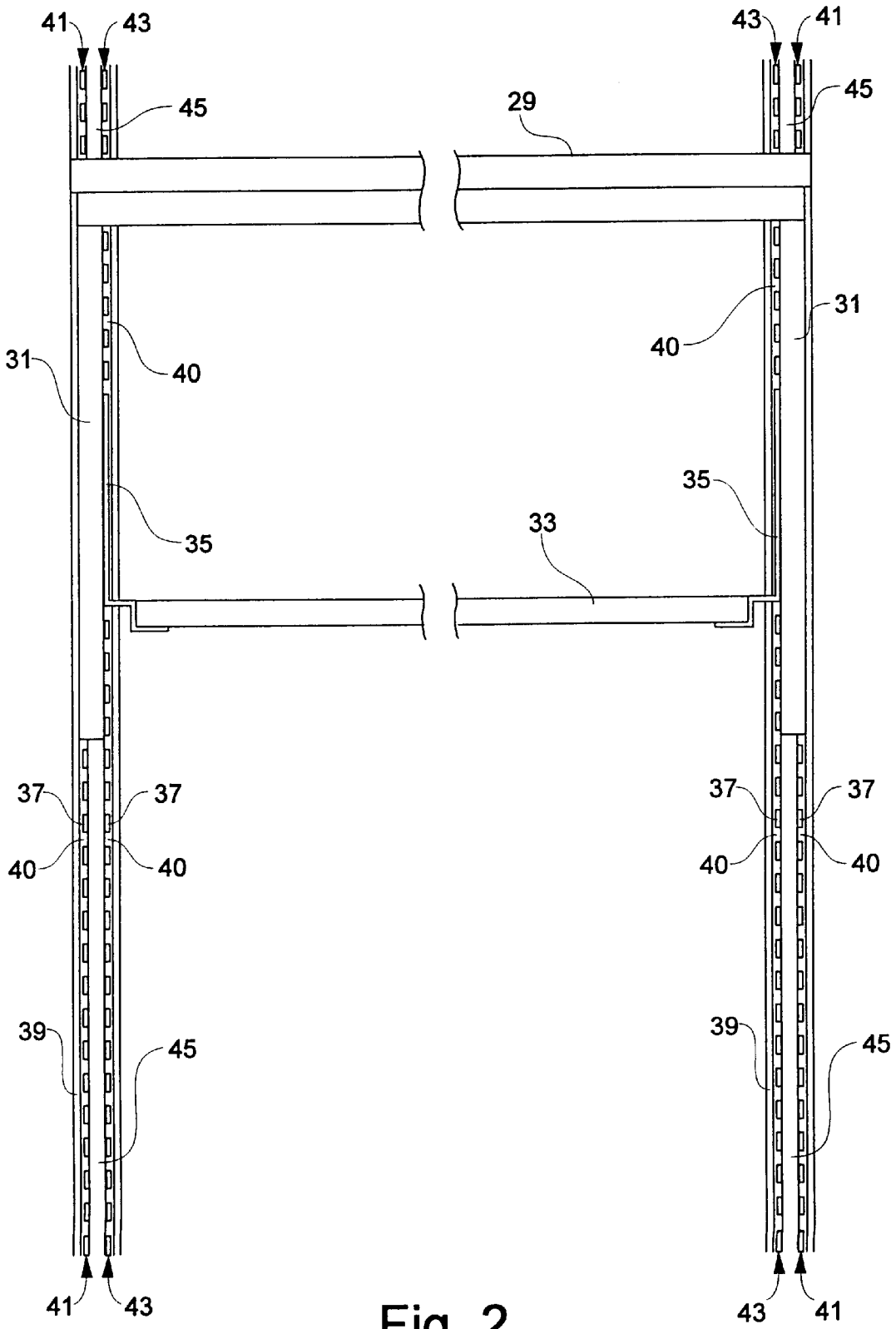
FIG. 2 is a front elevational view of the support assembly of FIG. 1.

FIG. 2 shows the support assembly 21 of the present invention in a front elevational view and depicts the openings 37. The two rows of openings 37 in each of the standards 27 together define two outermost opening rows 41 and two innermost opening rows 43. The first support member 23 is mounted in the openings 37 of the outermost rows 41, while the second support member 25 is mounted in the openings 37 of the innermost rows 43, as will be explained in greater detail below. Within each row 41,43, the openings 37 are separated by web portions 40.

The openings 37 can be configured in forms other than slots, and can be defined by arrangements other than the standards 27, such as, for example, modular channel nuts of the type sold by the Unistrut Corporation of Ann Arbor, Mich., and other sources, which can be mounted in a channel member for adjustable positioning therein, and which define a threaded opening for receiving threaded connectors for support of shelf brackets or other modular furniture elements. It is within the scope of the present invention to include such other arrangements for defining openings to be used in the mounting of support members.

FIG. 2 also depicts cover members 45 which are mounted in the central portion of each of the standards 27 intermediate the two opening rows 41,43 thereon. The cover members 45 will be discussed in greater detail presently in connection with FIGS. 7 and 8.

Figure 3:
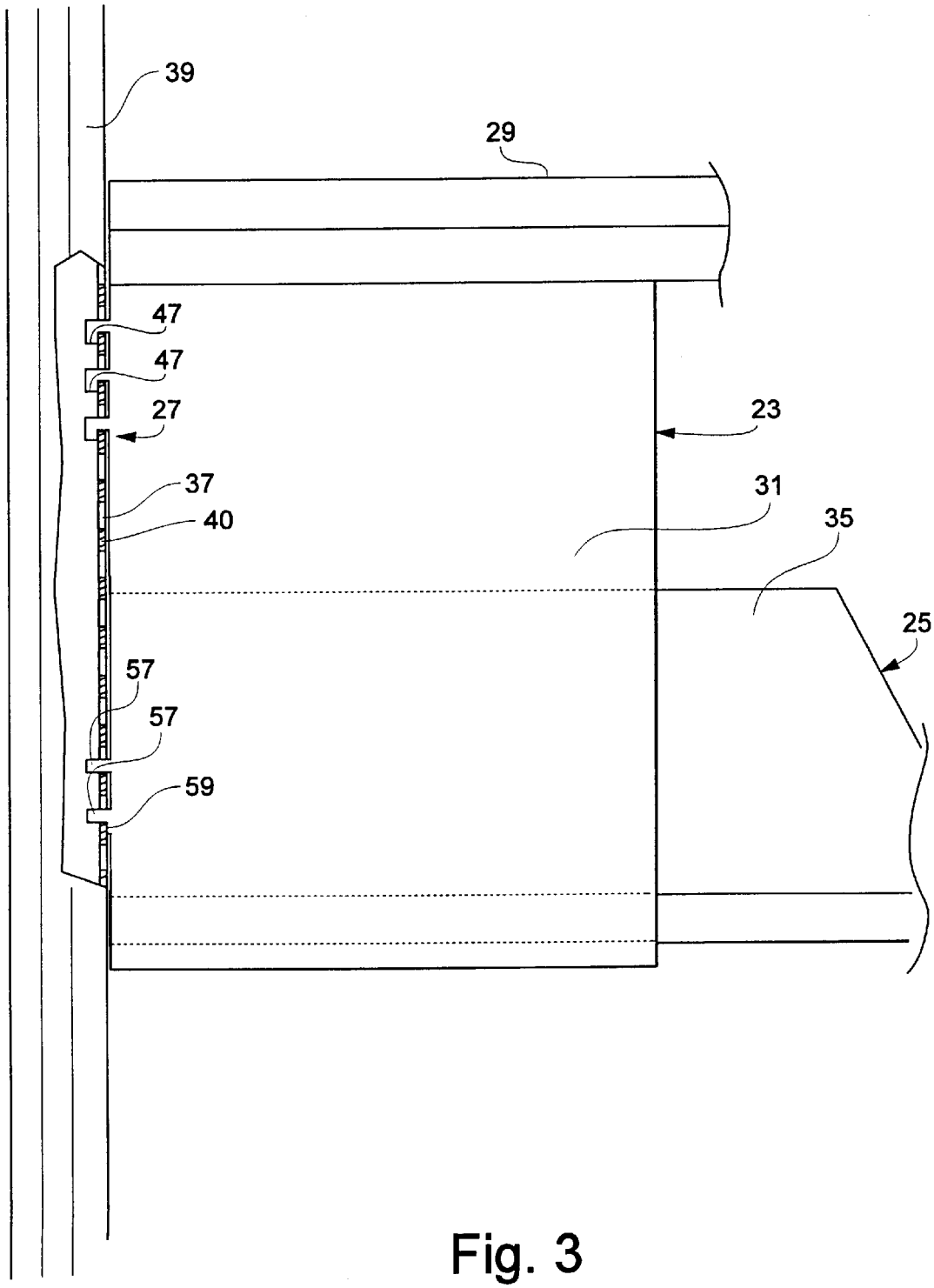
FIG. 3 is a side elevational view of the support assembly of FIG. 1, with a portion of a standard cut away to show mounting of one of the support members therein.

In FIG. 3, the first support member 23 and the second support member 25 are each shown mounted in one of the standards 27, with a portion of the standard 27 cut away to depict the mounting of the first support member 23 by a detachable mounting arrangement including connectors in the form of hooks 47, which are detachably mounted in the standard 27 by positioning the hooks 47 within the openings 37 so that corresponding web portions 40 are engaged within the recesses 55 formed by each of the hooks 47 (See FIGS. 4 and 5), as is conventional and well-known. The hooks 47 are easily removed from the standard 27 by disengaging web portion 40 from hook recess 55 and withdrawing the hook from the respective opening 37. The first support member 23 and the second support member 25 are both detachably mounted in standards 27 in this fashion and can be quickly and readily installed as desired in any of the appropriate locations along the rows 41,43 of openings 37.

Figure 4:
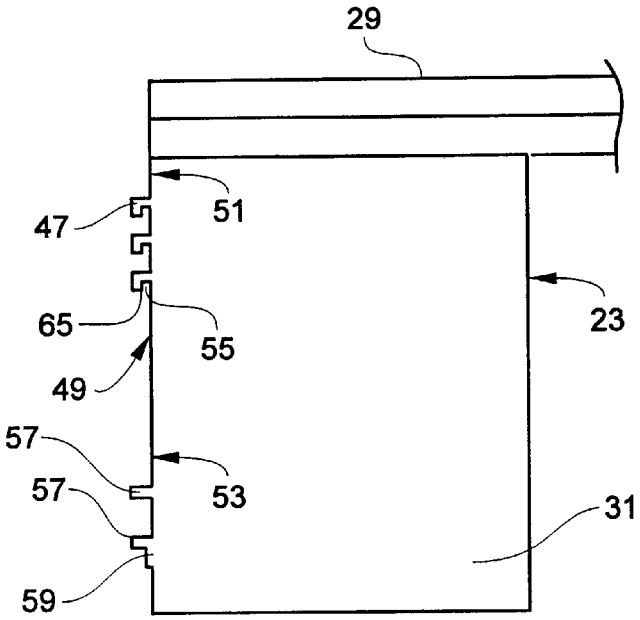
FIG. 4 is a side elevational view of one of the support members of FIG. 1.
Figure 5:
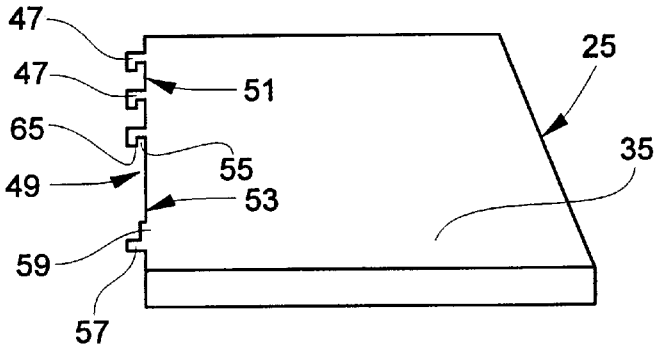
FIG. 5 is a side elevational view of the other of the support members of FIG. 1.

As best seen in FIGS. 4 and 5, the hooks 47 are formed on vertical edge portions 49 of the braces 31 of the first support member 23 and the braces 35 of the second support member 25. The vertical edge portions 49 each have an upper portion 51 and a lower portion 53, with the hooks 47 being located on the upper portions 51 so as to form the aforesaid downwardly facing recesses 55. Two outwardly projecting studs 57 and an outwardly projecting abutment 59 are formed on the lower portion 53 of the vertical edge portion 49 of the first support member 23, as seen in FIGS. 3 and 4, while one stud 57 and an outwardly projecting abutment 59 are formed on the lower portion 53 of the vertical edge portion 49 of the second support member 25, as seen in FIGS. 5 and 6.

Figure 6:
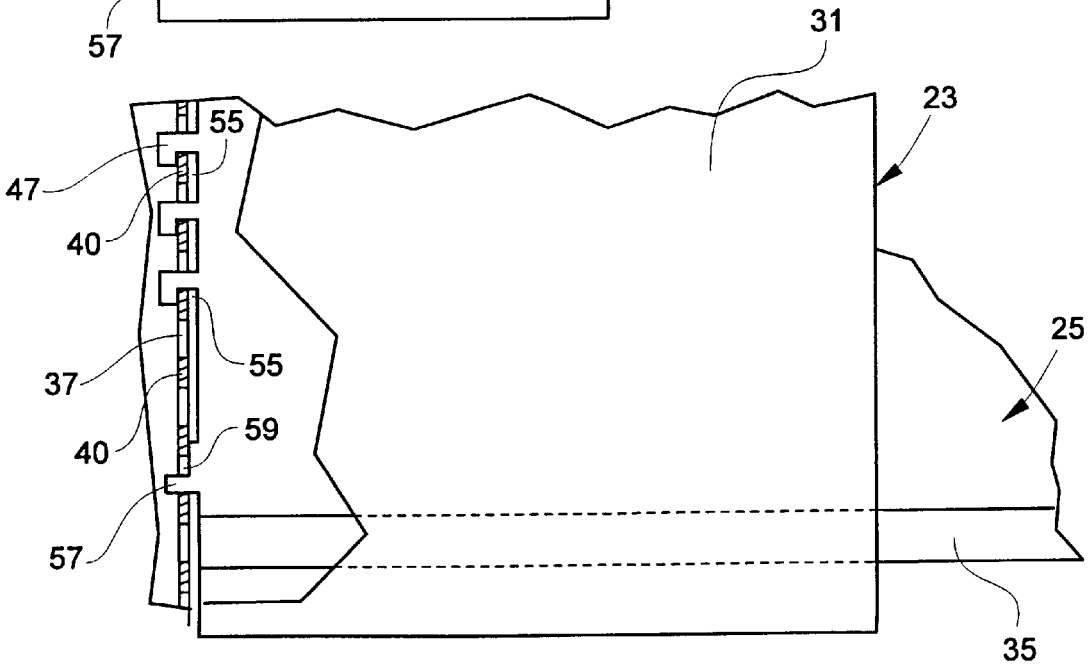
FIG. 6 is a side elevational view of the support assembly of FIG. 1, with a portion of a standard cut away to show mounting of the other of the support members therein.

Each of the studs 57 is received in one of the openings 37, as seen in FIGS. 3 and 6, so as to align the respective lower portion 53 with the respective row 41 or 43 of openings 37. The abutments 59 project outwardly from the lower vertical edge portion 53 to a lesser extent than the studs 57, and abut one of the web portions 40 so as to space the respective lower portion 53 from the standard 27 for a purpose to be described presently. FIG. 6 depicts the second support member 25 mounted in one of the standards 27 which, along with the first support member 23, has been cut away to show the above-described detachable mounting arrangement.

Figure 8:
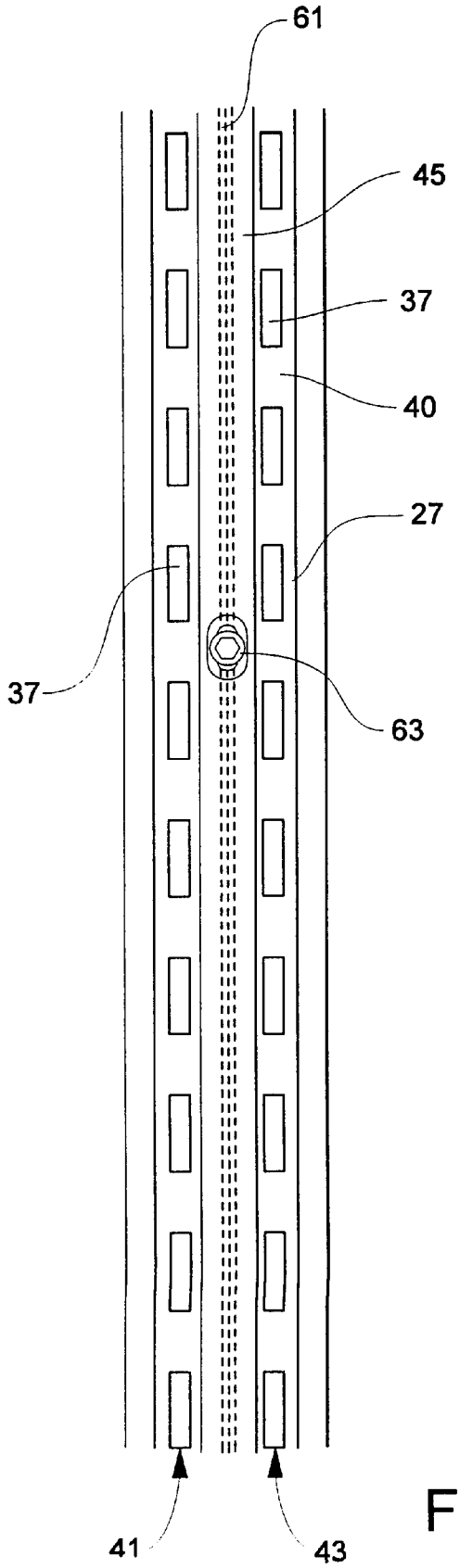
FIG. 8 is a detailed view of a portion of the support assembly of FIG. 1 showing mounting of the cover member on one the standards.
Figure 7:
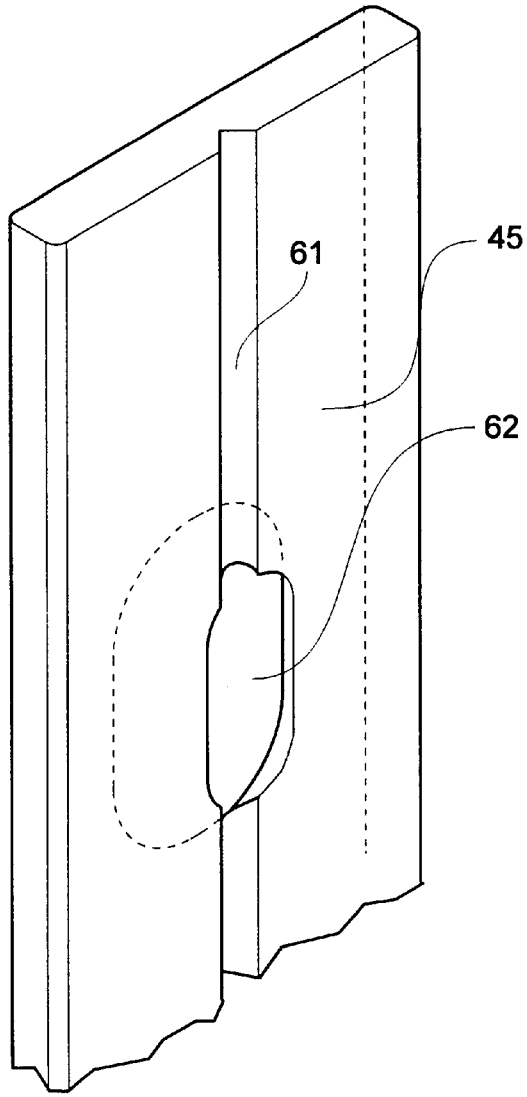
FIG. 7 is a perspective view of the cover member of the present invention.

FIG. 7 illustrates the cover member 45 in an uninstalled condition, with a guide groove 61 formed in a face of the cover member 45. A countersunk slot-shaped hole 62 is formed on the cover member 45 at the guide groove 61 for mounting on one of the standards 27. In FIG. 8, the cover member 45 can be seen installed on a central portion of the standard 27 by means of a conventional threaded fastener 63 engaged through the slot-shaped hole 62 into the standard 27, with the guide groove 61 positioned against the standard 27 so that it is not visible. The cover member 45 is preferably composed of aluminum, and other materials may be used without departing from the scope of the present invention.

Installation of the support assembly 21 of the present invention is easy, convenient, and quickly accomplished. The standards 27 are secured in stanchions 39 or, as noted above, in other posts or the like, or mounted to a wall. The first support member 23 can be installed at a wide variety of locations along the length of the opening row 41 for optimal positioning, depending upon the function to be served. For example, if the work surface 29 of the first support member 23 is to be utilized as a desk or work bench, it can be positioned at the appropriate height for use by either a standing or sitting person. If the first support member 23 is to be used for storage or other support of items, it can be positioned at the appropriate height for this function.

The second support member 25 can likewise be positioned at its optimal location, advantageously including positions between the braces 31 of the first support 23. This feature allows the support surface or shelf 33 of the second support member to be installed under the work surface 29 in relatively close relation, a configuration which can be beneficial in many situations, for example, where a relatively clear work surface 29 is required, but computers, other electronic components, or other test equipment must be positioned on shelf 33 close to the work surface 29. The present invention thus provides a high degree of flexibility and a variety of advantageous options in the relative positioning of the first support member 23 and the second support member 25.

Mounting of the first support member 23 and the second support member 25 is readily accomplished by inserting the respective hooks 47 and studs 57 in the appropriate openings 37 in the desired rows 41,43. Following insertion of the hooks 47, the respective support member is moved slightly downwardly to engage the web portions 40 in the hook recesses 55 for mounting engagement therein. The studs 57, as seen in FIGS. 3 and 6, will then project into the appropriate opening 37 so as to align the lower vertical edge portion 53 of the respective support member. In the preferred embodiment, the first support member 23 has two stud members 57 for aligning the lower portion 53, but a single stud member 57 will also provide alignment of the lower portion 53.

Abutment 59, which in its preferred embodiment is formed contiguously with a portion of the stud 57, contacts one of the web portions 40, as noted above, to thereby space the lower portion 53 from standard 27. This arrangement assists in leveling the work surface 29 and also provides, for each support member, a single abutment point on each lower portion 53 for engagement of the standard 27, thereby avoiding the more unpredictable and variable engagement provided when the greater extent of the lower portion 53 abuts the standard 27, which can result in a loose, shifting engagement producing rattles or an undesirable impression of insubstantial support. The abutment 59 thus provides for more solid and predictable engagement between the abutment 59 and the standards 27, producing a solid and substantial feel for the user. The abutments 59 also facilitate installation and removal of the support members 23,25 by preventing any binding between the lower vertical edge portions 53 and the standards 27.

The dimensions of the web portions 40, the hook recesses 55, and the abutment 59 are configured to also provide for secure engagement of the components of the support assembly of the present invention. In one preferred embodiment, the standard 27 and its web portions 40 have a thickness of 0.104", the recesses 55 formed by the hooks 47 each have a lateral dimension of 0.228" from the vertical edge 49 to the inner edge 65 of the respective hook 47 (see FIGS. 4 and 5), and the abutments 59 each project outwardly from the lower vertical edge portion 53 a distance of 0.125". This configuration provides the desired secure yet detachable engagement of the components of the support assembly of the present invention, but a wide variety of other configurations and dimensions which do not depart from the principles of the present invention are within its scope.

The braces 31,35, the hooks 47, the studs 57, and the abutments 59 of the present invention are, preferably, formed from steel or other material having sufficient rigidity to reliably support appropriate loads. In the preferred embodiment, the hooks 47, studs 57, and abutments 59 are welded to the respective braces 31,35, although other means of attachment such as use of threaded fasteners, rivets, or the like are within the scope of the present invention. Also, the hooks 47, studs 57, and abutments 59 can be formed integrally with the braces 31,35. It should also be noted that the second support member 25 could be formed without braces 35, in which case the hooks 47 would be secured to the shelf 33.

The cover members 45 are readily installed on the standards 27 through the use of the aforementioned threaded fasteners 63 or the like, with the fasteners being engaged through the slot-shaped holes 62 formed in the guide grooves 61 of the cover members 45 and into appropriate bores or openings (not shown) in the standards 27 for securing to the stanchions 39. In this manner, the threaded fasteners 63 can be employed to secure the cover members 45 and to assist in securing the standards 27 to the stanchions 29. The holes 62 can be predrilled in the cover member 45 for ease of installation, and the guide grooves 61 assist in accurately positioning the cover members 45 for such predrilling.

The cover members 45 provide a pleasing appearance to the standards 27 and make the openings 37 less visible. By giving the cover members 45 and the stanchions 39 a light color, and the standards 27 a dark color, it has been discovered that the openings 37 are not normally visible except at close range, which gives the support assembly 21 of the present invention heightened aesthetic appeal.

The support assembly 21 of the present invention therefore possesses significant advantages, in that the arrangement of the outermost rows 41 and the innermost rows 43 of the openings 37 permits the second support member 25 to be readily positioned between the braces of the first support member 23 at a convenient and useful position. This feature provides the present invention with advantageous flexibility in the positioning of the two support members relative to each other and enhances the utility of the present invention by allowing it to be configured as desired and required by many different applications.

The abutments 59 provide for secure and solid mounting of the support members 23,25, producing stable and solid support for the work surface 29 and the shelf 33. For applications in which a high degree of precision is required, such as laboratory or other technical environments, the stability provided for the work surface 29 by the abutments 59 is highly advantageous and desirable. Moreover, the abutments 59 assist in making installation and removal of the support members 23,25 convenient, easy, and quick.

The present invention also permits large braces 31 to be used for supporting of the work surface 29 without any loss of the ability to position a shelf 33 in convenient and close relation. For applications requiring support of heavy equipment, such as the aforementioned laboratory application, the ability to carry such heavy loads without loss of flexibility in positioning the shelf 33 and work surface 29 is highly beneficial and increases the usefulness of the present invention.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A support assembly for a furniture system, comprising:

a pair of standards extending vertically in spaced relation, each of said standards having an innermost and an outermost row of openings formed therein to extend vertically in spaced relation to one another, the outermost rows of openings in said pair defining a first spacing therebetween and the innermost rows of openings in said pair defining a second spacing therebetween less than said first spacing wherein said innermost rows are located between said outermost rows;

a first support member mounted on said standards by first means for detachably mounting disposed in said outermost rows of openings, said first support member having a first support surface extending outwardly from said standards and braces extending vertically along said outermost rows of openings, respectively; and a second support member mounted on said standards and between said braces by second means for detachably mounting disposed in said innermost rows of openings, said second support member having a second support surface extending outwardly from said standards intermediate said braces of said first support member.

2. The support assembly of claim 1, wherein said first support surface is a work surface.

3. The support assembly of claim 1, wherein said second support surface is a shelf.

4. The support assembly of claim 1, wherein said braces extend downwardly from said first support surface.

5. The support assembly of claim 1, wherein said openings are formed as slots, said braces each have a first vertical edge portion adjacent one of said standards, said first means for detachably mounting includes a hook projecting outwardly and downwardly from each of said first vertical edge portions for detachable mounting engagement in one of said slots in said outermost rows of openings, said second support member has a pair of second vertical edge portions, each of said second vertical edge portions being adjacent one of said standards, and said second means for detachably mounting includes a hook projecting outwardly and downwardly from each of said second vertical edge portions for detachable mounting engagement in one of said slots in said innermost rows of openings.

6. The support assembly of claim 5, wherein said first means for detachably mounting includes a plurality of said hooks and said second means for detachably mounting includes a plurality of said hooks.

7. The support assembly of claim 5, wherein each of said first vertical edge portions includes an upper portion and a lower portion, each of said hooks of said first means for detachably mounting projects outwardly and downwardly from said upper portion of said respective vertical edge portion, and further including a stud projecting outwardly from each of said lower portions for insertion into one of said slots in said outermost rows of openings for alignment of said lower portion and said slot.

8. The support assembly of claim 5, wherein each of said standards include web portions intermediate said slots in each of said rows of openings, each of said first vertical edge portions includes an upper portion and a lower portion, each of said hooks of said first means for detachably mounting projects outwardly and downwardly from said upper portion of said respective vertical edge portion, and further including an abutment projecting outwardly from said lower portion of each of said vertical edge portions for contacting one of said web portions of said standard to space said lower portion from said standard.

9. The support assembly of claim 8, further including a stud projecting outwardly from each of said lower portions for insertion into one of said slots in said outermost rows of openings for alignment of said lower portion and said slot.

10. The support assembly of claim 9, wherein each of said abutments on said lower portions is formed integrally with one of said studs.

11. The support assembly of claim 1, wherein each of said standards includes a central portion disposed intermediate said rows of openings, an elongated cover member for covering said central portion, and means for mounting said cover member to said central portion.

12. A support assembly for a furniture system, comprising:

a pair of standards extending vertically in spaced relation, each of said standards having an innermost row and an outermost row of slots formed therein to extend vertically in spaced relation to one another, the outermost rows of slots in said pair defining a first spacing therebetween and the innermost rows of slots in said pair defining a second spacing therebetween less than said first spacing wherein said innermost rows are located between said outermost rows, each of said standards further having web portions formed intermediate of said slots in said innermost and outmost rows;

a first pair of brackets each having a brace with a vertical edge portion extending along one of said standards and having an upper vertical edge portion and a lower vertical edge portion, a plurality of hooks projecting outwardly and downwardly from each of said upper vertical edge portions for detachable mounting engagement in said outermost row of slots in said respective standard, a stud projecting outwardly from each of said lower vertical edge portions for insertion into one of said slots in said outermost rows for alignment of said lower vertical edge portion and said slot, and an abutment projecting outwardly from each of said lower vertical edge portions for contacting one of said web portions to space said lower vertical edge portion from said standard;

a work surface mounted on said first pair of brackets and extending outwardly from said standards;

a second pair of brackets each having a vertical edge portion extending along one of said standards and a plurality of hooks projecting outwardly and downwardly from said vertical edge portion for detachable mounting engagement in said innermost row of slots in said respective standard; and a support surface mounted on said second pair of brackets and extending outwardly from said standards intermediate said braces.

13. The support assembly of claim 12, wherein each of said standards includes a central portion disposed intermediate said innermost and outermost rows of slots, an elongated cover member for covering said central portion, and means for mounting said cover member to said central portion.

14. A support assembly for a furniture system, comprising:

a pair of stanchions extending vertically in spaced relation;

means for defining an innermost and an outermost row of openings formed to extend vertically in spaced relation to one another on each of said stanchions so that said outermost rows of openings on said pair of stanchions have a first spacing therebetween and said innermost rows of openings in said pair have a second spacing therebetween less than said first spacing wherein said innermost rows are located between said outmost rows;

a first support member mounted on said stanchions by first means for detachably mounting disposed in said outermost rows of openings, said first support member having a first support surface extending outwardly from said stanchions and braces extending vertically along said outermost rows of openings, respectively; and a second support member mounted on said stanchions and between said braces by second means for detachably mounting disposed in said innermost row of openings, said second support member having a second support surface extending outwardly from said stanchions intermediate said braces of said first support member.

15. The support assembly of claim 14, wherein said first support surface is a work surface.

16. The support assembly of claim 14, wherein said second support surface is a shelf.

17. The support assembly of claim 14, wherein said braces extend downwardly from said first support surface.

18. The support assembly of claim 14, wherein said braces each have a first vertical edge portion adjacent one of said stanchions, said first means for detachably mounting includes a connector member projecting outwardly from each of said first vertical edge portions for detachable mounting engagement in one of said openings in said outermost rows of openings said second support member has a pair of second vertical edge portions, each of said second vertical edge portions being adjacent one of said stanchions, and said second means for detachably mounting includes a connector member projecting outwardly from each of said second vertical edge portions for detachable mounting engagement in one of said openings in said innermost rows of openings.

19. The support assembly of claim 18, wherein said first means for detachably mounting includes a plurality of said connectors projecting outwardly from each of said vertical edge portions for detachable mounting engagement in said openings in said outermost rows of openings.

* * * * *